United States Patent [19]

Moertel

[11] 4,337,889

[45] Jul. 6, 1982

[54] RECLOSABLE BAG WITH SLIDE FASTENER

[75] Inventor: George B. Moertel, Conneautville, Pa.

[73] Assignee: Talon, Inc., Meadville, Pa.

[21] Appl. No.: 119,063

[22] Filed: Feb. 6, 1980

[51] Int. Cl.[3] ..... B65D 33/20

[52] U.S. Cl. ..... 229/62; 206/632

[58] Field of Search ..... 229/62; 190/3, 43, 41 Z; 206/632

[56] References Cited

U.S. PATENT DOCUMENTS

| | | | |
|---|---|---|---|
| 2,109,533 | 3/1938 | Hurrey et al. | 229/62 |
| 2,699,286 | 1/1955 | Geffroy | 229/62 |
| 3,154,239 | 10/1964 | Madgen | 229/62 |
| 3,203,621 | 8/1965 | Wright | 229/62 |
| 3,727,829 | 4/1973 | Hüni | 229/62 |
| 4,241,865 | 12/1980 | Ferrell | 229/62 |

*Primary Examiner*—Stephen P. Garbe

*Attorney, Agent, or Firm*—O'Brien & Marks

[57] ABSTRACT

A bag with an elongated opening formed at one end thereof is opened and closed by means of a slide fastener having its respective tapes attached to the respective sides of the opening. Means, such as a rippable line of stitches, a low peel adhesive on an inner portion of one tape, etc., is provided to hold the bag closed and prevent tension on the coupling elements of the slide fastener during shipping and storing of the bag and its contents.

3 Claims, 20 Drawing Figures

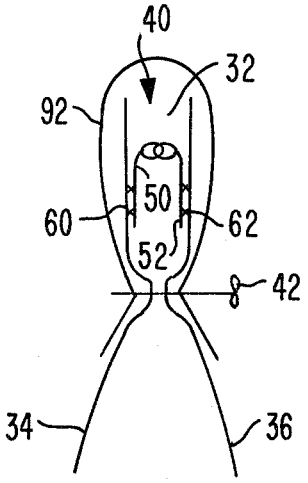
FIG. 16
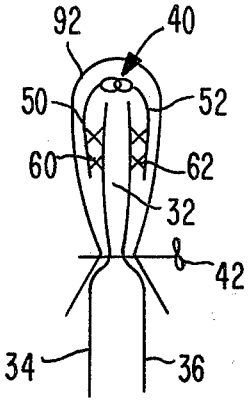
FIG. 17
FIG. 18
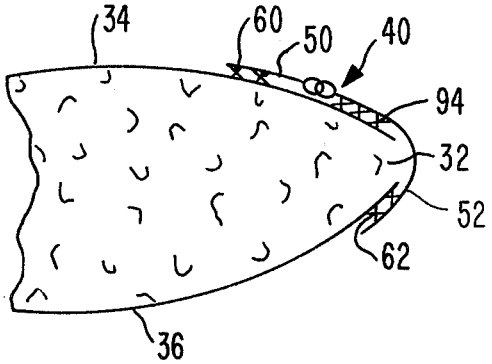
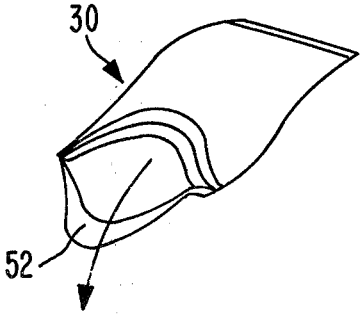
FIG. 19
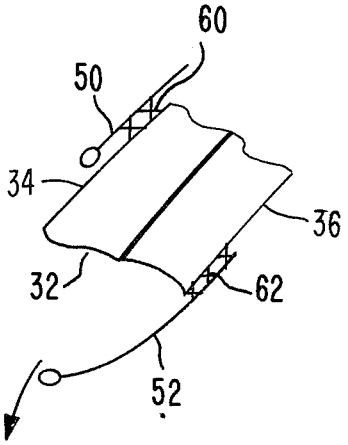
FIG. 20

RECLOSABLE BAG WITH SLIDE FASTENER

TECHNICAL FIELD

The invention relates to reclosable bags used for containing quantities of bulk material.

DESCRIPTION OF THE PRIOR ART

Bulk material for use by consumers is often filled, stored, shipped and sold in bags formed from paper and/or polymer resin materials wherein end openings of the bags are closed by lines of easily rippable stitches. The bags often also include cover strips folded over the end openings and secured by the stitching. The bags are opened by ripping the stitches and removing the cover strips. If the entire contents of the bags are not used and it is desired to store the remaining contents of thereof, such bags do not contain any provision for reclosing the opening.

Reclosable bags are disclosed in the prior art, for example U.S. Pat. Nos. 3,619,395, 3,625,270 and 3,780,781, wherein plastic bags are sealed completely around their edges and have interlocking rib and groove members extending across the interior of the bags below top portions which contain tear strips or tear lines for permitting the tops of the bag to be opened to expose the interlocking rib and groove structure. The prior art reclosable bags suffer from one or more deficiencies such as being subject to failure due to the weight and shifting of bulk material because of insufficient interlocking between the rib and groove members, being relatively difficult to bring about locking and unlocking the rib and groove members, etc.

It has previously been suggested to provide a elongated tear strip across an upper portion of one side wall of a bag which has its top closed in a conventional manner wherein a slide fastener is secured on the inside of the upper side wall portion around the tear strip so that the slide fastener serves as a reclosable opening once the tear strip is removed. The perforations made to form such tear strip tend to weaken the bag which can cause failure to the bag during shipping, handling or storing; a number of the bags may be stacked creating internal pressure in the bulk material which exceeds the strength of the tear strip as well as the fastener.

SUMMARY OF THE INVENTION

The invention is summarized in a reclosable bag including a bag body having two side walls and an elongated opening formed between end portions of the two side walls, a slide fastener having a pair of support tapes and a pair of rows of coupling elements mounted on the inner longitudinal edges of the support tape, a pair of attachment means attaching the tapes to the respective side walls adjacent the opening, and an easy peelable adhesive securing an inner portion of one support tape to the opposite side wall from which the one support tape is attached by the corresponding attachment means.

An object of the invention is to construct a reclosable bag which is relatively inexpensive and has sufficient strength in the closure to withstand shifting and internal pressure from the bag contents during shipping, storing and handling.

Other objects, advantages and features of the invention will be apparent from the following description of the preferred embodiment taken in conjunction with the accompanying drawings.

BRIEF DESCRIPTION OF THE DRAWINGS

FIG. 16 is a cross section view similar to FIG. 2 but of a fourth modified reclosable bag.

FIG. 17 is a cross section view similar to FIG. 2 but of a fifth modified reclosable bag.

FIG. 18 is a cross section view of a broken-away portion of a still further modified reopenable and closable bag.

FIG. 19 is a perspective view illustrating employment of a bag in accordance with one aspect of the invention.

FIG. 20 is a cross section view of a broken-away portion of the bag being employed in FIG. 19.

DESCRIPTION OF THE PREFERRED EMBODIMENTS

Figure 1:
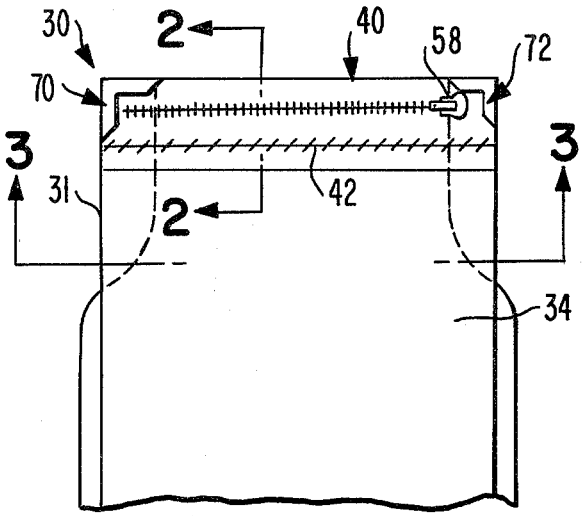
FIG. 1 is a front elevational view of a broken away top portion of a reclosable bag constructed in accordance with the invention.
Figure 2:
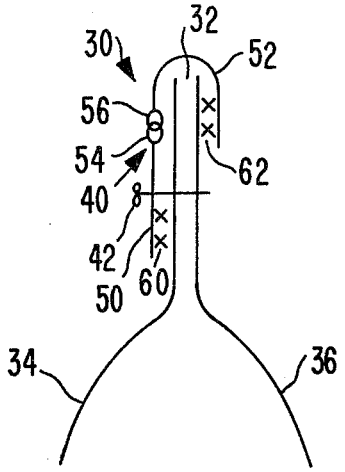
FIG. 2 is cross section view taken at line 2—2 in FIG. 1.
Figure 3:
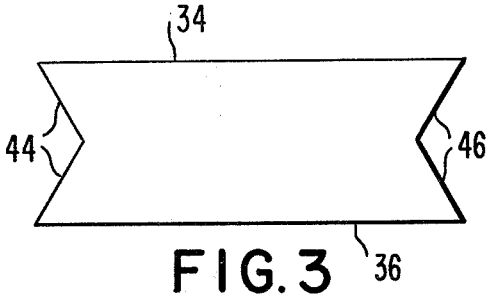
FIG. 3 is a cross section view taken at line 3—3 in FIG. 1.

As illustrated in FIGS. 1, 2 and 3, an embodiment of the invention includes a bag indicated generally at 30 which has an elongated opening 32 formed at its top defined by the upper edges of front side wall 34 and rear sidewall 36 wherein a slide fastener indicated generally at 40 is secured to the side walls 34 and 36 and wherein a line of easy rippable stitches 42 secure the upper ends of the sidewalls 34 and 36 together. The bag 30 is used for storing, shipping or otherwise handling bulk particulate or powder material. Once the bag is purchased by the user of the material therein, the stitching 42 may be ripped from the upper end of the bag and the slide fastener used as a reclosable closure to permit the user to remove a small quanity of material and subsequently reclose the bag to store the remaining material.

The bag body 31 is formed from conventional materials, such as paper and/or polymer resin, in a conventional manner to be suitable for shipping and storing the bulk material to be contained within the bag. In the bag of FIGS. 1–3, the bag body 31 has pleated side walls 44 and 46 so that the body 31 assumes a rectangular cross section when filled with material.

Figure 4:
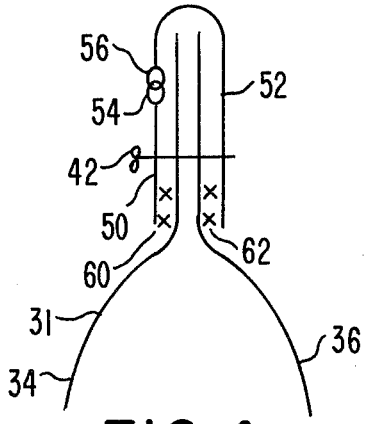
FIG. 4 is a cross sectional view similar to FIG. 2 but of a modified reclosable bag.
Figure 5:
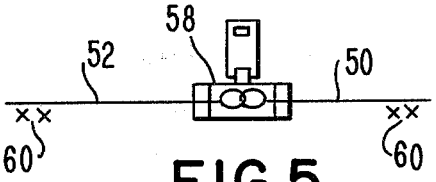
FIG. 5 is a cross section view of a slide fastener prior to installation in the modified reclosable bag of FIG. 4.

The slide fastener 40 includes a pair of tapes 50 and 52 which have respective rows of interlocking coupling elements 54 and 56 mounted on inner edges of the respective tapes 50 and 52. A slider 58 is slidably mounted on the interlocking coupling elements 54 and 56 for engaging and disengaging the coupling elements by movement of the slider. The tapes 50 and 52 are secured to the respective side walls 34 and 36 by attachment means such as strips 60 and 62 of adhesive. The tape 52 of the slide fastener 40 is folded over the upper ends of the front and back walls 34 and 36. In FIG. 2, the stitching 42 forming the rip strip passes through the tape 50 along with the walls 34 and 36 while in the modified variation of FIG. 4 the stitching 42 passes through both of the tapes 50 and 52. In the modification of FIG. 4, the tape 52, as shown in FIG. 5, is made with a width substantially greater than the tape 50 so that the tape 52 will accommodate the fold over the upper ends of the walls 34 and 36 and extend downward sufficiently to be secured by the stitching 42.

Figure 7:
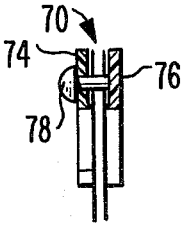
FIG. 7 is a cross section view taken at line 7—7 in FIG. 6.
Figure 6:
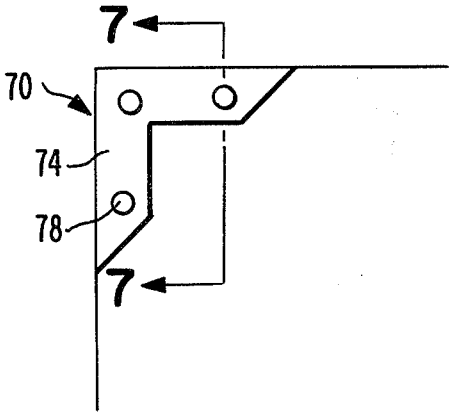
FIG. 6 is an elevational view of a broken-away corner portion of the bag of FIG. 1 including a corner reinforcement.
Figure 8:
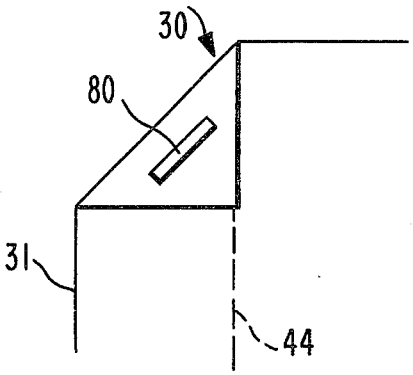
FIG. 8 is an elevation view of a broken-away corner portion of a reclosable bag including a variation of the corner reinforcement for the bag.
Figure 9:
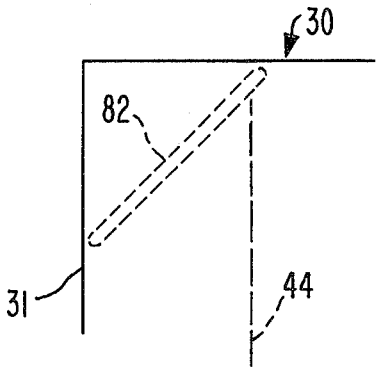
FIG. 9 is an elevation view of a broken-away corner portion of a reclosable bag including a second variation of the corner reinforcement of the bag.
Figure 10:
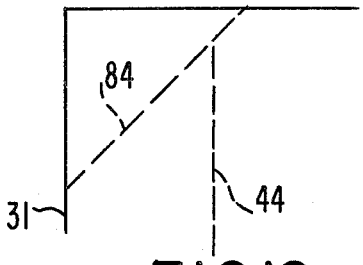
FIG. 10 is an elevation view of a broken-away corner portion of a reclosable bag including a third variation of the corner reinforcement for the bag.
Figure 11:
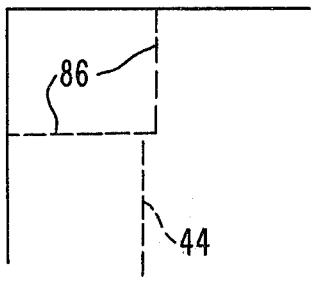
FIG. 11 is an elevation view of a broken-away corner portion of a reclosable bag including a fourth variation of the corner reinforcement for the bag.

Corner reinforcements 70 and 72 can be applied to the upper corners of the bag 30 to prevent the slide fastener from being torn or subject to excessive stress at the corner openings. The corner reinforcements 70 and 72, as shown for the reinforcement 70 in FIGS. 6 and 7, can each include a pair of angled members 74 and 76 positioned in front and back of the corners of the bag and having a 90 degree angle conforming with the bag corners with fasteners 78 securing the members 74 and 76 together and to the bag 30. In a corner reinforcement variation shown in FIG. 8, the reinforcement includes a staple 80 applied to the corner; in the illustrated variation of FIG. 8, the corner is first folded prior to applying the staple to even further increase the reinforcement. In the corner reinforcement variation of FIG. 9, the inside surfaces of the walls at the corner have a adhesive 82 applied thereto, to hold the walls together and reinforce the corner. In the variations shown in FIGS. 10 and 11 lines of stitches 84 and 86, respectively, are applied to the corners to reinforce the corners; the line of stitches 84 being straight and extending diagonally so as to form a triangle with the corner whereas the line of stitches 86 in FIG. 11 passes through a 90° angle so as to form a square or rectangle with the corner.

Figure 12:
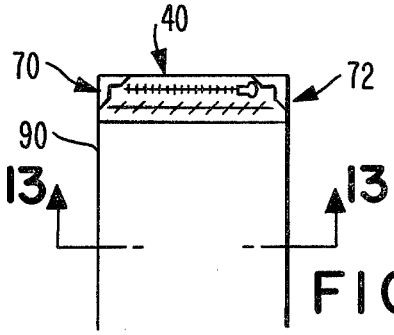
FIG. 12 is a elevation view similar to FIG. 1 but of another bag variation.
Figure 13:
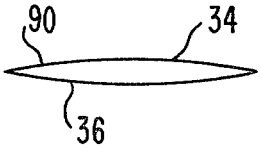
FIG. 13 is a cross section view taken at line 13—13 in FIG. 12.

In a modified reclosable bag illustrated in FIGS. 12 and 13, a flat bag body 90 is substituted for the bag body 31 of the embodiment of FIGS. 1–5. The front wall 34 and rear wall 36 of the bag are directly connected together without any intervening pleated side wall. A cross section of the fastener 40 and upper end of the bag 90 is substantially similar to the cross section shown in FIG. 2 or FIG. 4.

In employment or use of the reclosable bags of FIGS. 1–13, the bag body 31 or 90 is filled in a conventional manner. Then the slide fastener 40 is folded and placed over the top edges of the side walls 34 and 36 which are pressed together and sewn by the rip stitching 42. The slide fastener 50 replaces the conventional cover strip which is normally sewn on the top of a bag. During the holding and placement of the slide fastener 40 on the top of the bag, the slide fastener tapes 50 and 52 are bonded to the outside surfaces of the upper portions of the respective side walls 34 and 36, for example by the adhesive strips 60 and 62. The fold in the slide fastener 40 is formed longitudinally through one tape 52 so that the elements 54 and 56 are positioned on one side of the bag to avoid interference with operation of the slider 58 caused by the elements 54 and 56 being positioned at the fold. The corner reinforcements 70 and 72 can then be applied.

Once the bag with its contents are purchased by the user of the contents, and it is desired to remove a quantity of the contents from the bag, the user may rip the stitching 42 from the bag in a conventional manner and open the slide fastener 40 by operating the slider 58 to permit removable of material from the bag. As shown in FIGS. 19 and 20, when the bag is tilted with the back wall 36 and tape 52 downward, the tape 52 folds open to form a pouring spout for the contents.

After the desired quantity of material has been removed from the bag, the bag may be again closed by operation of the slider 58 to prevent contamination of the contents as well as accidental spilling of the contents.

Figure 14:
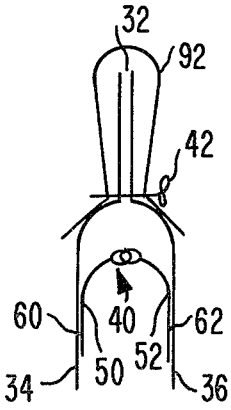
FIG. 14 is a cross section view similar to FIG. 2 but of a second modified reclosable bag.
Figure 15:
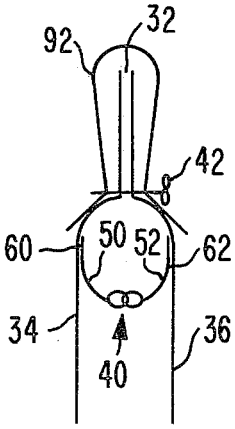
FIG. 15 is a cross section view similar to FIG. 2 but of a third modified reclosable bag.

In the modified bags of FIGS. 14–17, the slide fastener 40 is positioned either above or below the rip stitching 42. In FIGS. 14 and 15, the slide fastener 40 is below the line of stitches 42 and has its tapes 50 and 52 bonded to inside surfaces of the walls 34 and 36 within the bag. The slide fastener 40 in FIG. 14 has the outer longitudinal edges of the tapes 50 and 52 bent downward from the rows of coupling elements and away from the opening while the slide fastener 40 in FIG. 15 has the outer longitudinal edges of the tapes 50 and 52 bent upward from the rows of coupling elements and toward the upper opening of the bag. In FIGS. 16 and 17 the slide fastener 40 is positioned above the ripable stitches 42; the slide fastener 40 in FIG. 16 having its tapes 50 and 52 bonded to the inside surfaces of the upper portions of the walls 34 and 36 while the slide fastener 40 in FIG. 17 has its tapes 50 and 52 bonded to the outside surfaces of the upper portions of the walls 34 and 36. The bonds between the tapes 50 and 52 and the walls 34 and 36 can be made by strips of adhesive. In FIGS. 14 through 17, a conventional cover strip 92 is folded over the top of the bag and secured by the rip stitches 42.

In employment of the bags of FIGS. 14–17, the rip strips or stitches 42 are ripped from the bags and the cover strip 92 is removed. Thereafter the slide fastener 40 may be utilized to open and close the bag to dispense quantities of the material within the bag.

A further modified bag illustrated in FIG. 18 has the tapes 50 and 52 at their outer edges secured to the outside surfaces of the respective walls 34 and 36 by high strength adhesive strips 60 and 62 or other high strength bonding means. The tape 52 is folded over the opening 32 of the bag so that the inner portion of the tape 52 also extends over the upper portion of the wall 34 adjacent the opening 32. An adhesive 94 joins this inner portion of the tape 52 to the wall 34. The adhesive 94 is selected to have a relatively high shear strength but a low peel strength so that once the slide fastener 40 is opened, the inner portions of the tape 52 can be peeled from the wall 34 to open the bag. The employment of the high sheer low peel adhesive 94 permits the elimination of the rip strip stitching 42 necessary to hold the bags closed during shipping and handling of the bag and contents. Stress on the opening from the pressure of the contents of the bag is applied to the tape 52 which avoids applying such stress to the fastening elements of the slide fastener. This permits a low cost slide fastener to be employed where the strength of the coupling elements and their attachments to the tapes are of less strength than the tensile strength of the tapes themselves.

Since many variations, modifications and changes in detail may be made in the above described embodiments of the invention, it is intended that all matter in the foregoing description and in the accompanying drawings be interpreted as illustrative and not in a limiting sense.

What is claimed is:

1. A reclosable bag comprising a bag body having two side walls and an elongated opening formed between end portions of the two side walls, a slide fastener having a pair of support tapes and a pair of rows of coupling elements mounted on the inner longitudinal edges of the support tapes, a pair of attachment means attaching the tapes to the respective side walls adjacent the opening, and an easy peelable adhesive securing an inner portion of one support tape to the opposite side wall from which the one support tape is attached by the corresponding attachment means.

2. A reclosable bag as claimed in claim 1 wherein said attachment means includes respective strips of high-strength adhesive.

3. A reclosable bag as claimed in claim 1 or 2 wherein the slide fastener, when opened, has one half thereof extending beyond the side walls of the bag for forming a pouring spout for the bag.

* * * * *